US007607953B2

(12) United States Patent
Fabian

(10) Patent No.: US 7,607,953 B2
(45) Date of Patent: Oct. 27, 2009

(54) SPRING-LOADED CONTACT FOR ELECTRICAL CONDUCTORS

(75) Inventor: David James Fabian, Mount Joy, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/948,199

(22) Filed: Nov. 30, 2007

(65) Prior Publication Data

US 2009/0142972 A1 Jun. 4, 2009

(51) Int. Cl.
*H01R 4/40* (2006.01)

(52) U.S. Cl. ..... 439/789

(58) Field of Classification Search ..... 439/789, 439/835, 816, 817, 822, 851
See application file for complete search history.

(56) References Cited

U.S. PATENT DOCUMENTS 845,268 A 2/1907 Schade, Jr.
3,827,007 A * 7/1974 Fairbairn et al. ..... 439/293
3,846,735 A * 11/1974 Carter et al. ..... 439/284
4,084,876 A * 4/1978 Dinger ..... 439/439
4,708,417 A * 11/1987 Woertz ..... 439/828
4,824,395 A 4/1989 Blaha
5,275,620 A * 1/1994 Darby et al. ..... 607/1
5,441,421 A * 8/1995 Ponticelli et al. ..... 439/284
5,679,021 A * 10/1997 Kramer ..... 439/835
5,975,940 A 11/1999 Hartmann et al.
5,984,738 A * 11/1999 Michelmann et al. ..... 439/786
5,993,270 A * 11/1999 Geske et al. ..... 439/835
6,152,763 A * 11/2000 Sai ..... 439/492
6,155,890 A 12/2000 Gerberding
6,746,286 B2 6/2004 Blaha
7,255,592 B1 8/2007 Tseng
2006/0228952 A1 * 10/2006 Feldman et al. ..... 439/835

* cited by examiner

*Primary Examiner*—T C Patel
*Assistant Examiner*—Vladimir Imas

(57) ABSTRACT

A contact for use with electrical conductors is provided. This contact includes a stationary engagement member; a flexible engagement member; and a biasing member (e.g., a spring) disposed between the stationary engagement member and the flexible engagement member. The action of the biasing member displaces the flexible engagement member from linear alignment with the stationary engagement member in the absence of compressive force on at least one of the engagement members. Compressive force applied to the stationary engagement member and/or the flexible engagement member brings these components into linear alignment with one another for creating a wire-receiving channel or "wire trap" that is activated upon removal of the compressive force.

13 Claims, 5 Drawing Sheets

SPRING-LOADED CONTACT FOR ELECTRICAL CONDUCTORS

BACKGROUND OF THE INVENTION

The described invention relates in general to terminal clips or fastening devices for the terminals of electrical conductors and more specifically to a spring-loaded contact for use with electrical conductors.

Spring-loaded electrical contacts or terminals are devices that are frequently incorporated into connector systems used with electrical conductors (e.g., electrical wire). Such electrical contacts may be used with either stranded or solid wire for providing a convenient and mechanically secure means by which to terminate the wire prior to making an electrical connection. Despite its widespread adoption, this type of electrical contact does suffer from a number of significant limitations. Particularly, many of these contacts have multiple-piece construction, which adds complexity and expense to the manufacturing process. Additionally, most prior art contacts of this type require high insertion force; therefore, the risk of buckling a wire (particularly stranded wire) during the termination process is significant. Finally, most prior art contacts of this type are not designed to accommodate different gauges of wire; thus, different size contacts are necessary for different gauges of wire. Thus, there is an ongoing need for an electrical contact having a single-piece construction and that is capable of easily accommodating multiple wire gauges that may or may not include multiple strands.

SUMMARY OF THE INVENTION

The following provides a summary of certain exemplary embodiments of the present invention. This summary is not an extensive overview and is not intended to identify key or critical aspects or elements of the present invention or to delineate its scope.

In accordance with one aspect of the present invention, a connector system for electrical conductors is provided. This system includes a first electrical contact adapted to receive a length of electrically conductive wire; a second electrical contact adapted to receive a length of electrically conductive wire and to receive a portion of the first electrical contact and form an electrical connection therewith; a first device adapted to receive the first electrical contact therein and temporarily compress the flexible engagement member of the first electrical contact into linear alignment with the stationary engagement member of the first electrical contact for creating a channel into which a length of electrical wire may be inserted; and a second device adapted to receive the second electrical contact therein and temporarily compress the flexible engagement member of the second electrical contact into linear alignment with the stationary engagement member of the second electrical contact for creating a linear channel into which a length of electrical wire may be inserted. Both the first and second electrical contacts include a stationary engagement member; a flexible engagement member; and a biasing member disposed between the stationary engagement member and the flexible engagement member. The biasing member displaces the flexible engagement member from linear alignment with the stationary engagement member in the absence of compressive force on one or both of the engagement members.

In accordance with another aspect of the present invention, a contact for use with electrical conductors is provided. This contact includes a stationary engagement member; a flexible engagement member; and a biasing member (e.g., a spring) disposed between the stationary engagement member and the flexible engagement member. The action of the biasing member displaces the flexible engagement member from linear alignment with the stationary engagement member in the absence of compressive force on the engagement members. Compressive force applied to the stationary engagement member and/or the flexible engagement member brings these components into linear alignment with one another for creating a wire-receiving channel or "wire trap".

In yet another aspect of this invention, a method for terminating an electrical conductor is provided. This method includes first providing an electrical contact adapted to receive a length of electrically conductive wire. The electrical contact includes a stationary engagement member; a flexible engagement member; and a biasing member disposed between the stationary engagement member and the flexible engagement member. The biasing member displaces the flexible engagement member from linear alignment with the stationary engagement member in the absence of compressive force on the engagement members. Next, the electrical contact is enclosed within an enclosure (e.g., a housing) that temporarily compresses the flexible engagement member of the contact into linear alignment with the stationary engagement member of the electrical contact and creates a channel into which a length of electrical wire may be inserted. Next, a length of stripped wire is inserted into the channel and, finally, linear force is exerted on the wire. Exerting force on the length of wire moves (i.e., slides) the contact within the enclosure thereby decompressing the flexible engagement member. Decompression of the flexible engagement member secure, i.e., "traps" the length of stripped wire between the stationary engagement member and the flexible engagement member.

Additional features and aspects of the present invention will become apparent to those of ordinary skill in the art upon reading and understanding the following detailed description of the exemplary embodiments. As will be appreciated by the skilled artisan, further embodiments of the invention are possible without departing from the scope and spirit of the invention. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more exemplary embodiments of the invention and, together with the general description given above and detailed description given below, serve to explain the principles of the invention, and wherein.

DETAILED DESCRIPTION OF THE INVENTION

Figure 1A:
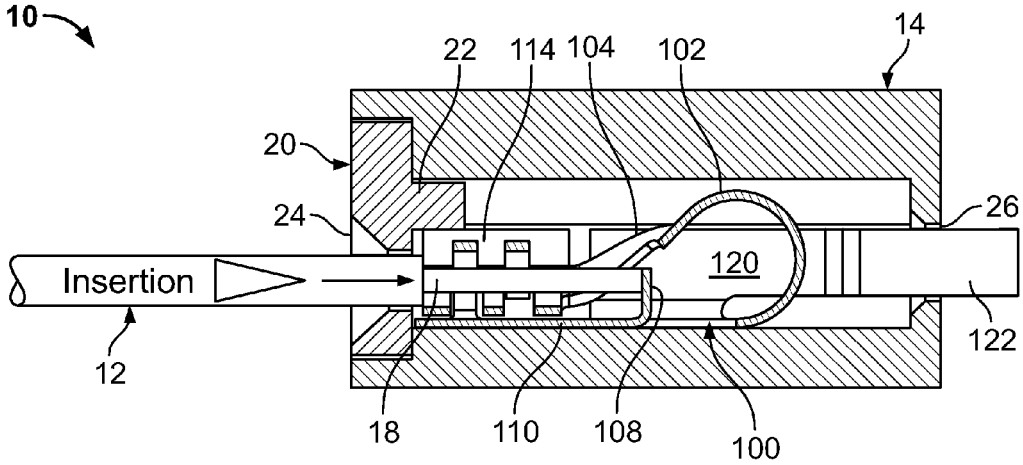
FIG. 1A is a cross-sectional view of an exemplary embodiment of the connector assembly of the present invention showing the male version of the contact inside the enclosure component in the preloaded state with an unsecured wire positioned in the trap portion of the contact.

Exemplary embodiments of the present invention are now described with reference to the Figures. Reference numerals are used throughout the detailed description to refer to the various elements and structures. In other instances, well-known structures and devices are shown in block diagram form for purposes of simplifying the description. Although the following detailed description contains many specifics for the purposes of illustration, a person of ordinary skill in the art will appreciate that many variations and alterations to the following details are within the scope of the invention. Accordingly, the following embodiments of the invention are set forth without any loss of generality to, and without imposing limitations upon, the claimed invention.

The present invention relates to electrical connector systems and electrical contacts for use with electrical systems and devices. As previously indicated, a first general embodiment of this invention provides a connector system for electrical conductors such as electrical wires; a second general embodiment of this invention provides a spring-loaded electrical contact; and a third general embodiment of this invention provides a method for terminating an electrical conductor such as an electrical wire. With reference now to the Figures, one or more specific embodiments of this invention shall be described in greater detail.

With reference now to the Figures, FIGS. 1-5 provide various views illustrative views of an exemplary connector system and exemplary electrical contacts in accordance with the present invention. FIGS. 1A-B and 2A-B provide cross-sectional side and perspective views of a connector assembly 10, which includes an enclosure in the form of housing 14 and contact 100, which is positioned within housing 14. In FIG. 1A, electrical wire 12, from which insulated portion 16 has been stripped to expose wire portion 18, is inserted into contact 100, which itself has been inserted into housing 14. In this exemplary embodiment, contact 100 includes biasing member 102 that is formed between stationary wire engagement member 110 and flexible wire engagement member 114. Bridge 104 connects biasing member 102 to flexible wire engagement member 114 and base 106 connects biasing member 102 to stationary wire engagement member 110. Wire stop 108 is formed on base 106 for providing a surface against which electrical wire 12 may act (described in greater detailed below). Body 120 is formed around the wire engagement members and tapers into a connecting blade 122 on the rear portion of the contact, thereby creating a male electrical contact. Loops 112 are formed at one end of stationary wire engagement member 110 and loops 116 are formed at one end of flexible wire engagement member 114 for creating a "wire trap" when the wire engagement members are not in linear alignment with one another (see FIG. 1B).

Figure 2A:
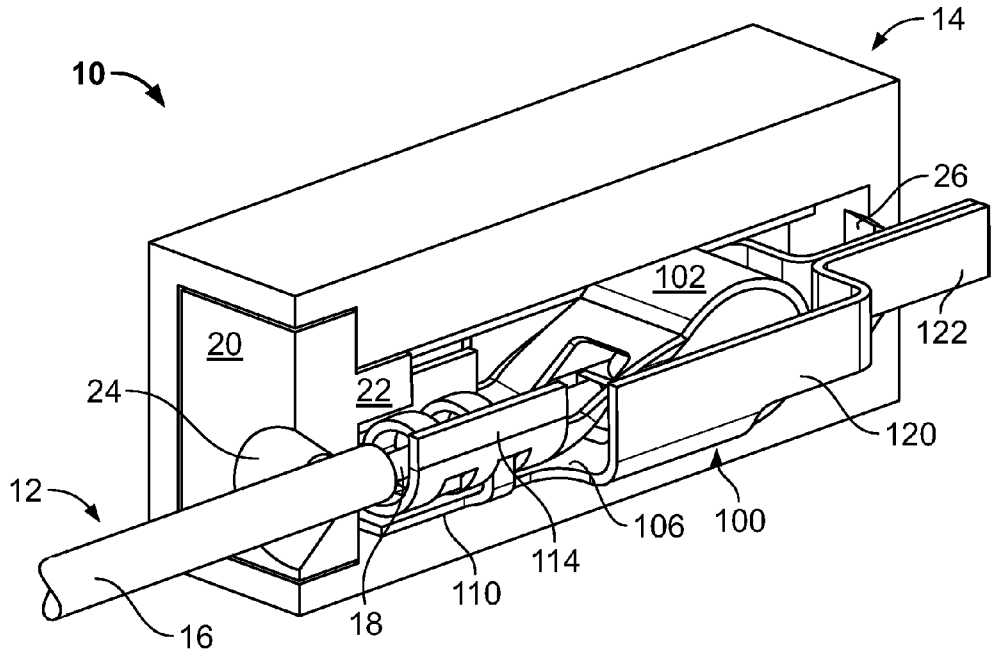
FIG. 2A is a cutaway front perspective view of the connector assembly of FIG. 1A showing the male version of the contact positioned within the housing in a preloaded state with the cap component installed in the front portion of the housing.
Figure 2B:
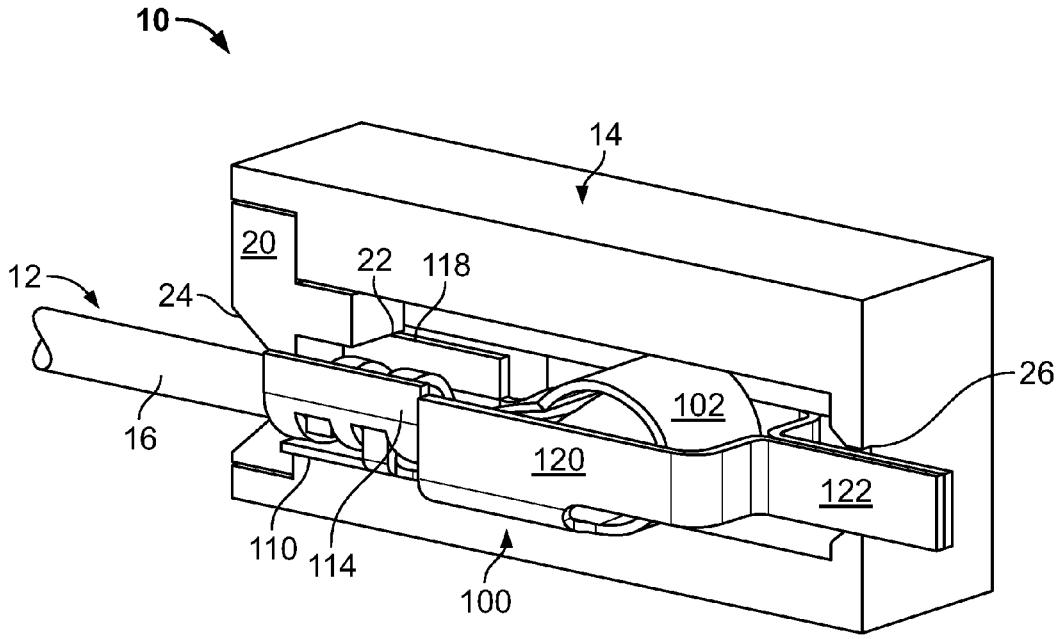
FIG. 2B is a rear perspective view of the connector assembly of FIG. 2A.
Figure 3:
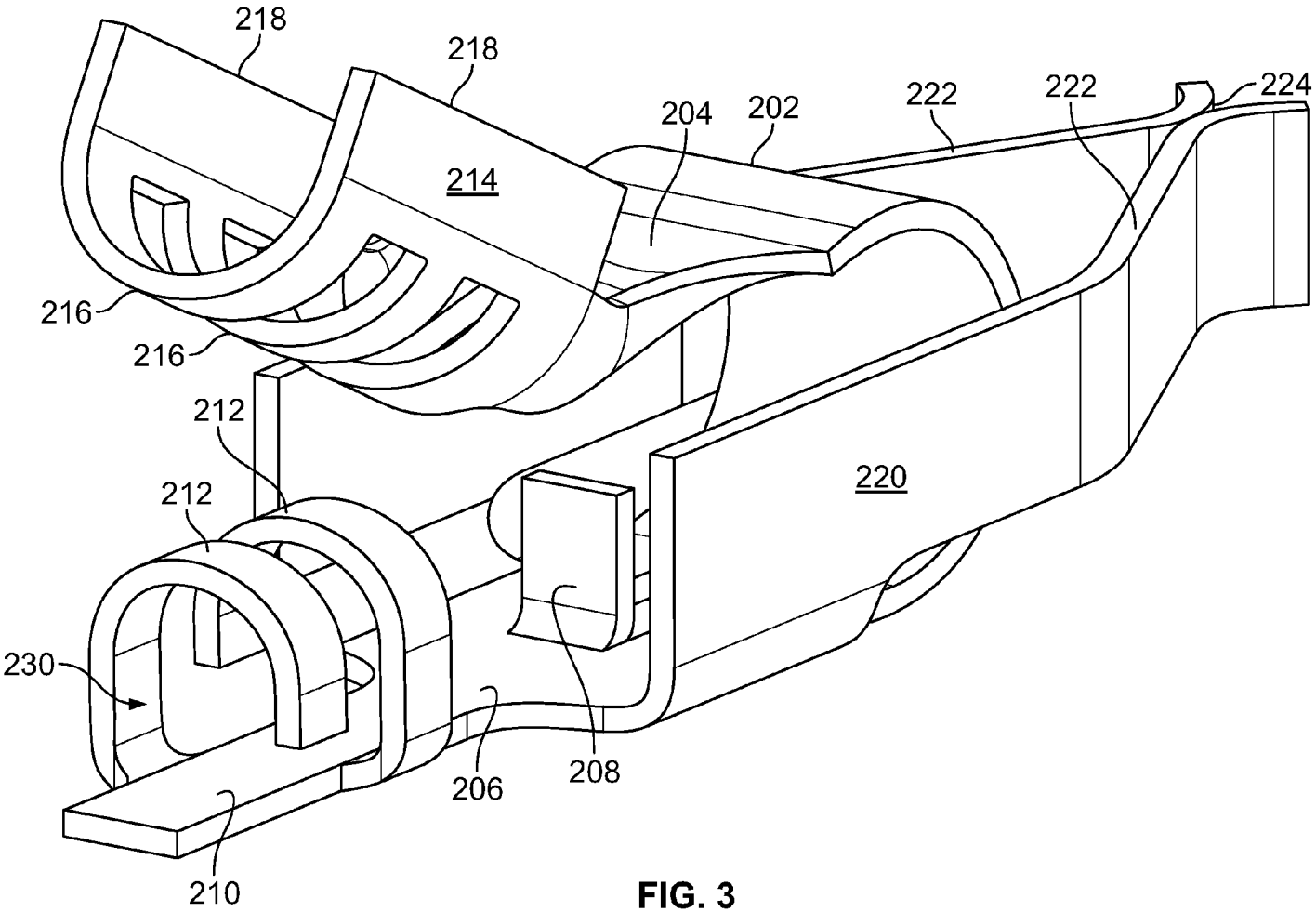
FIG. 3 is a top perspective view of an exemplary embodiment of the female version of the contact of the present invention removed from the housing and shown in a preloaded state in the absence of compressive force on the engagement members of the contact.

When contact 100 is not enclosed within housing 14, the normal spring action of biasing member 102 displaces flexible engagement 114 member from linear alignment with stationary engagement member 110 (see FIG. 3). Thus, for linear alignment between engagement members 110 and 114 to be maintained, contact 100 may be inserted into an inner chamber formed in housing 14 and cap 20 may then be inserted into one end of housing 14, as best shown in FIGS. 2A-B. When contact 100 is positioned within housing 14, blade 122 extends through aperture 26, which is formed in one end of housing 14. Cap 20 includes extended portion 22 and conical wire guide 24. Extended portion 22 engages top edge 118 of flexible wire engagement member 114 for compressing flexible wire engagement member 114 into linear alignment with stationary wire engagement member 110 to form channel 130 (see FIG. 4A) into which wire 12 is inserted. As will be appreciated by the skilled artisan, housing 14 and cap 20 are merely exemplary devices that may be used to provide compressive force to contact 100 and other systems or devices may be used for this purpose. In some embodiments of this invention, housing 14 and cap 20 are completely absent and other means are used for manually applying compressive force (in the direction of arrow "A" in the Figures) to the engagement members to maintain linear alignment therebetween prior to insertion of a wire into the contact.

Figure 4A:
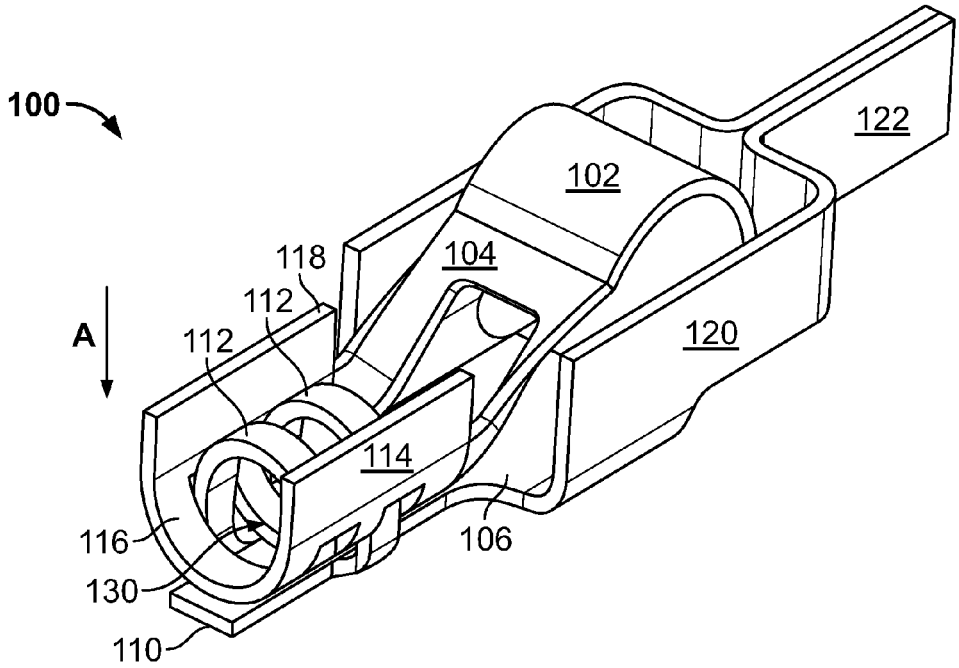
FIGS. 4A-B are top perspective views of exemplary male and female versions of the contact of the present invention shown in a preloaded state in the presence of compressive force.
Figure 4B:
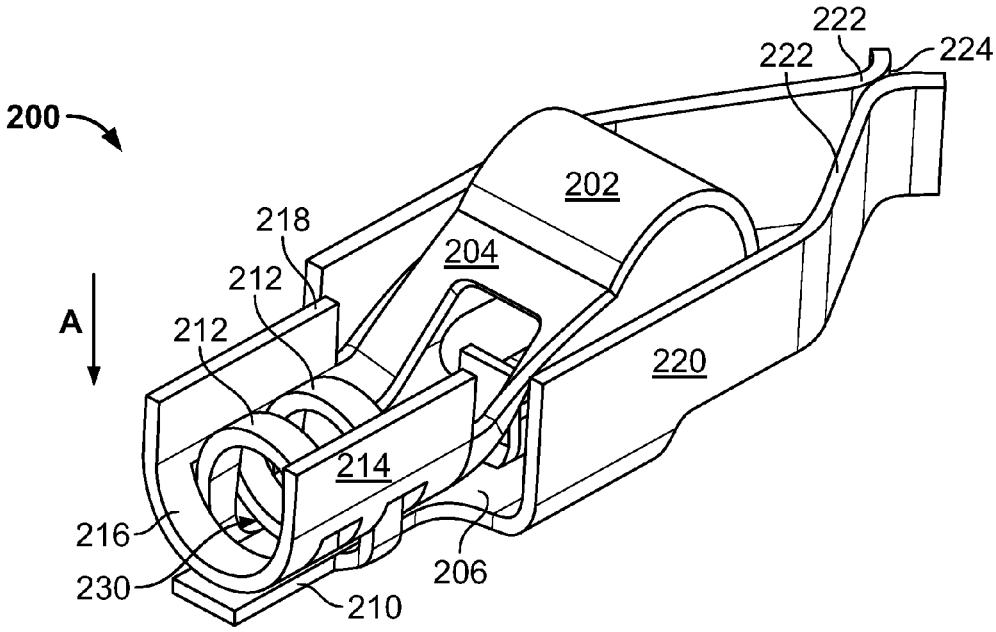

As shown in FIGS. 3 and 4B, the electrical contact of the present invention is also provided in a female version for use in a connector system. In the exemplary embodiment shown in FIG. 3, contact 200 includes biasing member 202 that is formed between stationary wire engagement member 210 and flexible wire engagement member 214. Bridge 204 connects biasing member 202 to flexible wire engagement member 214 and base 206 connects biasing member 202 to stationary wire engagement member 210. Wire stop 208 is formed on base 206 for providing a surface against which electrical wire 12 may act (described in greater detailed below). Body 220 is formed around the wire engagement members and tapers into inwardly-biased clasping members 222 on the rear portion of the contact, which form mating portion 224 for receiving blade 122 (see FIG. 5). Loops 212 are formed at one end of stationary wire engagement member 210 and loops 216 are formed at one end of flexible wire engagement member 214 for creating a "wire trap" when the wire engagement members are not in linear alignment with one another (see, for example, FIG. 1B). As previously described with reference to contact 100, the normal spring action of biasing member 202 displaces flexible engagement 214 member from linear alignment with stationary engagement member 210 as shown in FIG. 3. Thus, for linear alignment between engagement members 210 and 214 to be maintained when in use, contact 200 is also typically inserted into or otherwise used with either a mechanical or non-mechanical device or manual means that engage top edge 218 and applies compressive force to the wire engagement members to form wire-receiving channel 230.

Figure 5:
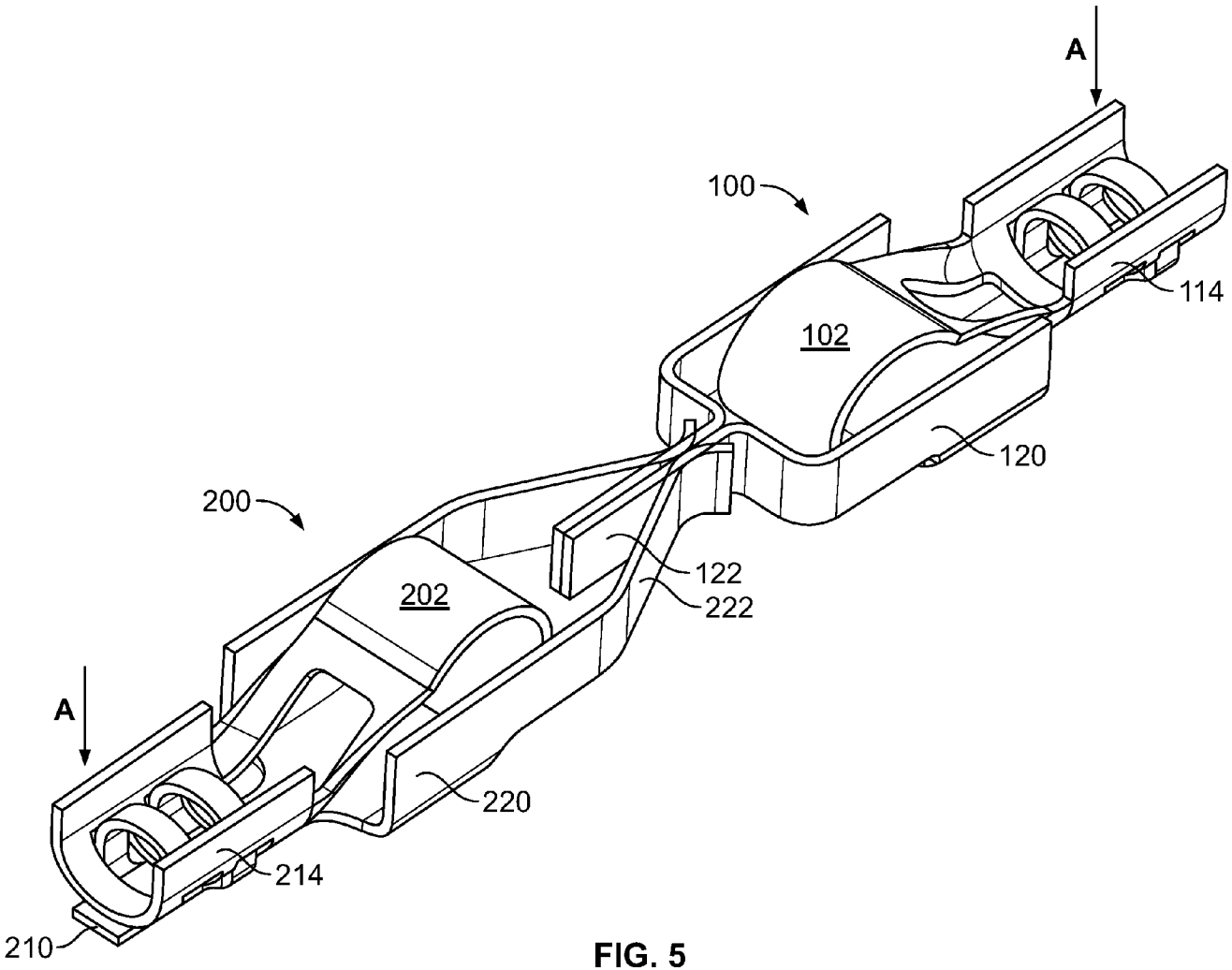
FIG. 5 are top perspective views of exemplary male and female versions of the contact of the present invention shown connected to one another for completing an electrical connection.

The present invention provides both a connector system for use with electrical conductors such as wire and an electrical contact for use in terminating electrical conductors. As shown in FIG. 5, the connector system aspect of the present invention includes both connector 100 and connector 200, wherein blade 122 is inserted into receiving portion 224 for forming a separable interface that connects the contacts to one another and establishes an electrical connection therebetween. As previously stated, both contacts 100 and 200 include a biasing member that disengages the wire engagement members from linear alignment with one another under normal "un-loaded" conditions. Therefore, a device or other means for providing compressive force (see arrow A in FIGS. 4A-B) to the wire engagement members is typically included as a component of connector assembly 10 so that a wire receiving channel is formed.

Figure 1B:
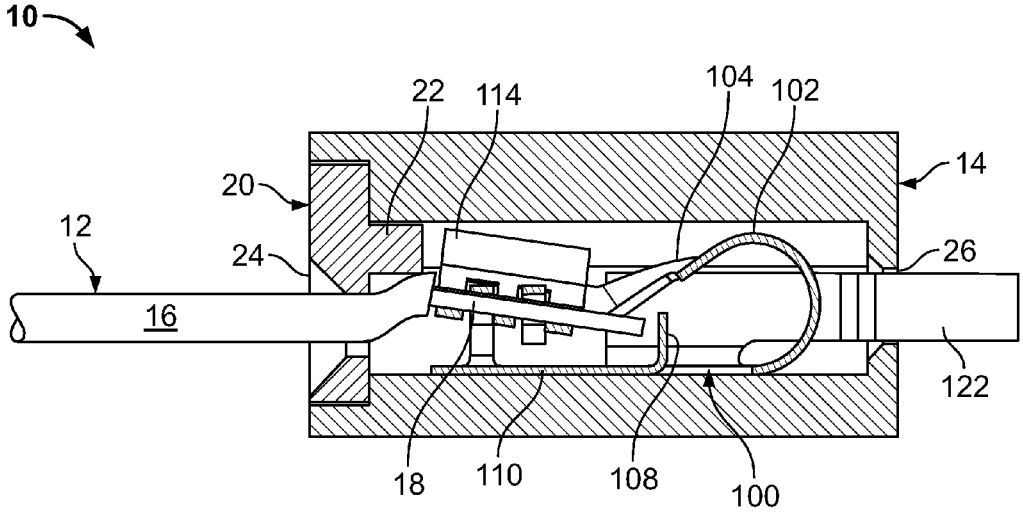
FIG. 1B is a cross-sectional view of the connector system of FIG. 1A showing the contact in the loaded state with a secured wire positioned in the trap portion of the contact.

As best shown in FIGS. 1A-B, connector assembly 10 is used to terminate an electrical conductor in the following manner. It is to be understood that while contact 100 is used in this description, contact 200 functions in essentially the same manner, and is interchangeable with contact 100 in terms of the described method for terminating an electrical conductor. First, contact 100 is inserted into housing 14 and wire engagement members 110 and 114 are compressed or otherwise brought into linear alignment with one another to form wire receiving channel 130 (see FIG. 4A). Cap 20 is then inserted into one end of housing 14 such that extended portion 22 engages top edge 118 for temporarily maintaining wire engagement members 110 and 114 in linear alignment with one another to create a "pre-loaded" state. Stripped portion 18 of wire 12 is then inserted (i.e., "loaded") into contact 100 though wire guide 24 such that stripped portion 18 makes contact with wire stop 108. Continuous force is then applied to wire 12 in a forward direction such that the entire contact 100 slides within housing 14 toward and partially through aperture 26. Top edge 118 gradually moves away from extended portion 22 and the compressive force of cap 20 is removed from wire engagement members 110 and 114. The spring action of biasing member 102 causes flexible wire engagement 114 member to move away from stationary wire engagement member 100, thereby trapping stripped portion 18 of wire 12 between loops 112 and 116 as shown in FIG. 1B. Once wire 18 is trapped in this manner, significant reverse force must be applied to the wire to remove it from contact 100. Thus, contact 100 provides an effective means for securing wire 12 within connector assembly 10.

Contacts 100 and 200 are each typically manufactured from a single piece of electrically conductive metal, such as copper alloy, according to known manufacturing and/or fabricating methods and techniques. Advantageously, contacts 100 and 200 may accommodate different gauges of wire as well as single stranded and multi-stranded wire. In most instances, the insertion force required to insert wire 12 and activate the wire trap portion of the contact is significantly less than is required by prior art spring-loaded electrical contacts. Thus, the risk of buckling or otherwise damaging the wire or other conductor is reduced with the present invention. Housing 14 may act as an insulator and may be manufactured from any suitable material or materials including dielectric materials.

While the present invention has been illustrated by the description of exemplary embodiments thereof, and while the embodiments have been described in certain detail, it is not the intention of the Applicant to restrict or in any way limit the scope of the appended claims to such detail. Additional advantages and modifications will readily appear to those skilled in the art. Therefore, the invention in its broader aspects is not limited to any of the specific details, representative devices and methods, and/or illustrative examples shown and described. Accordingly, departures may be made from such details without departing from the spirit or scope of the applicant's general inventive concept.

What is claimed:

1. A connector system for electrical conductors, comprising:

(a) a first electrical contact adapted to receive a length of electrically conductive wire in one end thereof, wherein the first electrical contact includes:

(i) a stationary engagement member, wherein the stationary engagement member further includes an elongated wire-capturing portion, and wherein the elongated wire-capturing portion further includes a plurality of loops;

(ii) a flexible engagement member, wherein the flexible engagement member further includes an elongated wire-capturing portion, and wherein the elongated wire-capturing portion further includes a plurality of arches; and (iii) a biasing member disposed between the stationary engagement member and the flexible engagement member, wherein the biasing member displaces the flexible engagement member from linear alignment with the stationary engagement member in the absence of compressive force on the engagement members, and wherein the displacement of the flexible engagement member from linear alignment with the stationary engagement member traps the length of electrically conductive wire between the plurality of loops formed on the stationary engagement member and the plurality of arches formed on the flexible engagement member;

(b) a second electrical contact adapted to receive a length of electrically conductive wire in one end thereof and to receive a portion of the first electrical contact and form an electrical connection therewith, wherein the second electrical contact further includes:

(i) a stationary engagement member, wherein the stationary engagement member further includes an elongated wire-capturing portion, and wherein the elongated wire-capturing portion further includes a plurality of loops;

(ii) a flexible engagement member, wherein the flexible engagement member further includes an elongated wire-capturing portion, and wherein the elongated wire-capturing portion further includes a plurality of arches;

(iii) a biasing member disposed between the stationary engagement member and the flexible engagement member, wherein the biasing member displaces the flexible engagement member from linear alignment with the stationary engagement member in the absence of compressive force on the engagement members, and wherein the displacement of the flexible engagement member from linear alignment with the stationary engagement member securely traps the length of electrically conductive wire between the plurality of loops formed on the stationary engagement member and the plurality of arches formed on the flexible engagement member; and (c) a first device adapted to receive the first electrical contact therein and temporarily compress the flexible engagement member of the first electrical contact into linear alignment with the stationary engagement member of the first electrical contact for creating a channel into which a length of electrical wire may be inserted; and (d) a second device adapted to receive the second electrical contact therein and temporarily compress the flexible engagement member of the second electrical contact into linear alignment with the stationary engagement member of the second electrical contact for creating a linear channel into which a length of electrical wire may be inserted.

2. The connector system of claim 1, wherein the first and second electrical contacts further comprise a separable interface for connecting the contacts to one another and establishing an electrical connection therebetween.

3. The connector system of claim 1, wherein the first electrical contact further includes female connecting means and wherein the second electrical contact further includes male connecting means for joining the contacts and establishing an electrical connection therebetween.

4. The connector system of claim 1, wherein each stationary engagement member further comprises at least one wire-grasping loop formed thereon, wherein each flexible engagement member further comprises at least one wire-grasping loop thereon, and wherein the loops on each contact cooperate with one another to trap an electrical conductor therebetween when the stationary engagement members are linearly displaced from the flexible engagement members.

5. The connector system of claim 1, wherein each electrical contact further includes a wire stop formed thereon.

6. The connector system of claim 1, wherein each electrical contact is formed from a single piece of electrically conductive metal.

7. A contact for use with electrical conductors, comprising:

(a) a stationary engagement member, wherein the stationary engagement member is adapted to directly receive a length of electrically conductive wire in one end thereof, wherein the stationary engagement member further includes an elongated wire-capturing portion, and wherein the elongated wire-capturing portion further includes a plurality of loops;

(b) a flexible engagement member, wherein the flexible engagement member is adapted to directly receive a length of electrically conductive wire in one end thereof, wherein the flexible engagement member further includes an elongated wire-capturing portion, and wherein the elongated wire-capturing portion further includes a plurality of arches; and (c) a biasing member disposed between the stationary engagement member and the flexible engagement member, wherein the biasing member displaces the flexible engagement member from linear alignment with the stationary engagement member in the absence of compressive force on the engagement members, and wherein the displacement of the flexible engagement member from linear alignment with the stationary engagement member securely traps the length of electrically conductive wire between the plurality of loops formed on the stationary engagement member and the plurality of arches formed on the flexible engagement member.

8. The contact of claim 7, further comprising a housing adapted to receive the electrical contact therein and temporarily compress the flexible engagement member into linear alignment with the stationary engagement member for creating a channel into which a length of electrical wire may be inserted.

9. The contact of claim 8, further comprising a wire stop formed thereon for providing a stationary surface against which an electrical wire may be used to apply linear force to the electrical contact within the housing and decompress the flexible engagement member.

10. The contact of claim 8, wherein the stationary engagement member further comprises at least one wire-grasping loop formed thereon, wherein the flexible engagement member further comprises at least one wire-grasping loop thereon, and wherein the loops cooperate with one another to trap an electrical conductor therebetween when the stationary engagement member is linearly displaced from the flexible engagement member.

11. The contact of claim 8, wherein the electrical contact further comprises female connecting means for connecting to another electrical contact.

12. The contact of claim 8, wherein the electrical contact further comprises male connecting means for connecting to another electrical contact.

13. The contact of claim 8, wherein the electrical contact is formed from a single piece of electrically conductive metal.

* * * * *